United States Patent [19]

Deaton

[11] 4,149,698

[45] Apr. 17, 1979

[54] SURFACE CONTROLLED SUBSURFACE SAFETY VALVE

[75] Inventor: Thomas M. Deaton, Dallas, Tex.

[73] Assignee: Otis Engineering Corporation, Dallas, Tex.

[21] Appl. No.: 787,103

[22] Filed: Apr. 13, 1977

[51] Int. Cl.[2] ..... F16K 11/20; E21B 43/12

[52] U.S. Cl. ..... 251/63.6; 166/324

[58] Field of Search ..... 251/62, 63.5, 63.6; 166/321, 324; 137/494

[56] References Cited

U.S. PATENT DOCUMENTS

| | | | |
|---|---|---|---|
| 3,583,442 | 6/1971 | Dollison | 251/63.4 X |
| 3,703,193 | 11/1972 | Rawlins | 166/324 X |
| 3,741,249 | 6/1973 | Leutwyler | 166/324 X |
| 3,827,494 | 8/1974 | Crowe | 166/324 X |
| 3,854,502 | 12/1974 | Mott | 166/324 X |
| 3,868,995 | 3/1975 | Crowe | 166/324 X |
| 3,993,136 | 11/1976 | Mott | 166/324 X |

*Primary Examiner*—Martin P. Schwadron
*Assistant Examiner*—A. Michael Chambers
*Attorney, Agent, or Firm*—Vinson & Elkins

[57] ABSTRACT

Disclosed is a surface controlled subsurface safety valve wherein the greater of well pressure and balance pressure assists in closing the safety valve. Well pressure assist for valve closure is obtained without creating additional depth sensitive limitations as the balance pressure approaches zero. Balance pressure assist for valve closure is obtained without well pressure tending to maintain the valve open. This abstract is neither intended to define the scope of the invention, which, of course, is measured by the claims, nor is it intending to be limiting in any way.

9 Claims, 5 Drawing Figures

SURFACE CONTROLLED SUBSURFACE SAFETY VALVE

BACKGROUND OF THE INVENTION

A. Field of the Invention

This invention relates to surface controlled subsurface safety valves utilized to control flow at a subsurface location in a well.

B. The Prior Art

Well pressure may assist closure of a surface controlled subsurface safety valve as disclosed in U.S. Pat. No. 3,703,193 to Raulins. However, as well pressure approaches zero such a safety valve becomes depth sensitive. As well pressure approaches zero, spring force, or other inherent resilient urging means, is relied upon to close the valve.

Some surface controlled subsurface safety valves, such as disclosed in U.S. Pat. No. 3,696,868 to Taylor, include a balance pressure chamber. Valve closure of such a safety valve may be assisted by pressurizing the balance pressure chamber. However, heretofore, designing a subsurface safety valve having a balance pressure chamber so that valve closure may be assisted by well pressure has resulted in increasing the depth sensitive limitations of the valve as the balance pressure approaches zero, vis a vis a valve without a balance pressure chamber. Also, heretofore, designing a subsurface safety valve having a balance pressure chamber so that a greater force tending to close the valve is produced when there is approximately the same pressure within both the balance pressure chamber and the control pressure chamber has resulted in well pressure tending to maintain the valve open.

OBJECTS OF THE INVENTION

It is an object of this invention to provide a surface controlled subsurface safety valve wherein valve closure may be assisted by the greater of well pressure and balance pressure.

It is another object of this invention to provide a surface controlled subsurface safety valve wherein well pressure may assist valve closure without increasing the depth limitations of the valve as balance pressure approaches zero.

It is another object of this invention to provide a surface controlled subsurface safety valve wherein the force effectiveness of balance pressure, which force tends to close the valve, is increased over the force effectiveness of control pressure and well pressure does not resist closure.

These and other objects and features of advantage of this invention will be apparent from the drawings, the detailed description and the appended claims.

BRIEF DESCRIPTION OF THE DRAWINGS

In the drawings, wherein like numerals indicate like parts, and wherein an illustrative embodiment of this invention is shown.

DETAILED DESCRIPTION OF THE PREFERRED EMBODIMENT

An important criterion that industry has selected for surface controlled subsurface safety valves is that valve closure be failsafe. Regardless of pressure conditions at the valve, the surface controlled subsurface safety valve should close upon reduction of control fluid pressure. If present, well pressure should assist valve closure and should not retard valve closure. Valve closure may also be assisted by pressure balancing fluid. The pressure balancing fluid communicates between the subsurface valve and the surface controls. It balances the hydrostatic head of control fluid pressure which is effective within the valve to retard valve closure. If desired, the pressure balancing fluid may be pressurized to provide a positive force to close the valve. Additional balance fluid pressure assistance for valve closure may be obtained by having a balance piston area which is larger than the control piston area. However, providing a balance piston area which is larger than the control piston area should not render the safety valve more depth sensitive vis a vis subsurface safety valves without a balance pressure chamber, as the balance pressure approaches zero and such a design should not result in well fluid pressure retarding valve closure.

The surface controlled subsurface safety valve of this invention obtains these desirable features. It closes with the assistance of the greater of well fluid pressure and balance fluid pressure. Additional balance pressure assistance for valve closure is attained without well pressure retarding valve closure and without increasing the depth sensitive limitations of the valve, via a vis, subsurface safety valves with only a single control conduit, as the balance fluid pressure approaches zero.

Figure 5:
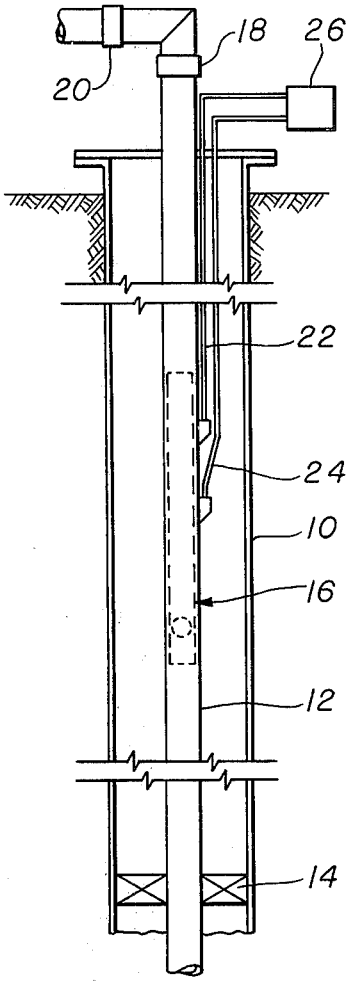
FIG. 5 is a schematic illustration of a well installation incorporating the safety valve of FIGS. 1 through 3.
Figure 4:
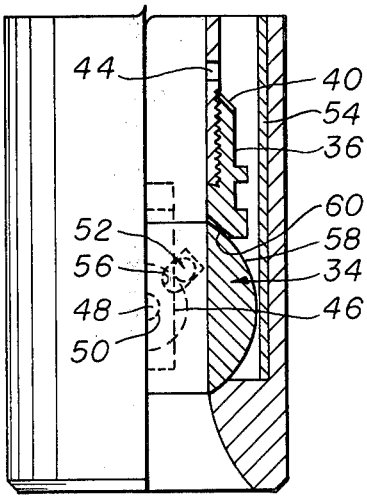
FIG. 4 is a partial quarter-sectional view showing the mounting for the ball valve member of the subsurface safety valve of FIGS. 1, 2 and 3.

A well installation incorporating the surface controlled subsurface safety valve of this invention is schematically illustrated in FIG. 5. The well is cased with the normal casing string 10. Through the casing string 10 extends a tubing string 12. Fluids from a producing formation (not shown) may be confined to within the tubing string 12 by sealing off the annulus between tubing string 12 and the casing 10 with packer means 14. Fluid flow through the tubing string 12 may be controlled at a subsurface location by subsurface safety valve 16 (shown in dotted form in FIG. 5). At the well surface, flow through the tubing string 12 may be controlled by surface valves 18 and 20. To control the subsurface safety valve 16 from the surface, control conduit means 22 and balance conduit means 24 extend between the valve 16 and the surface. At the surface, fluid is pressurized or depressurized and pumped into one of control conduit means 22 and balance conduit means 24 by operating manifold 26. Pressurizing control conduit means 22 opens the subsurface safety valve 16. Depressurizing control conduit means 22 permits closure of the subsurface safety valve 16. Closure of the subsurface safety valve 16 is assisted by the greater of well fluid pressure at the location of the subsurface safety valve 16 and balance fluid pressure within balance conduit means 24.

Figure 1:
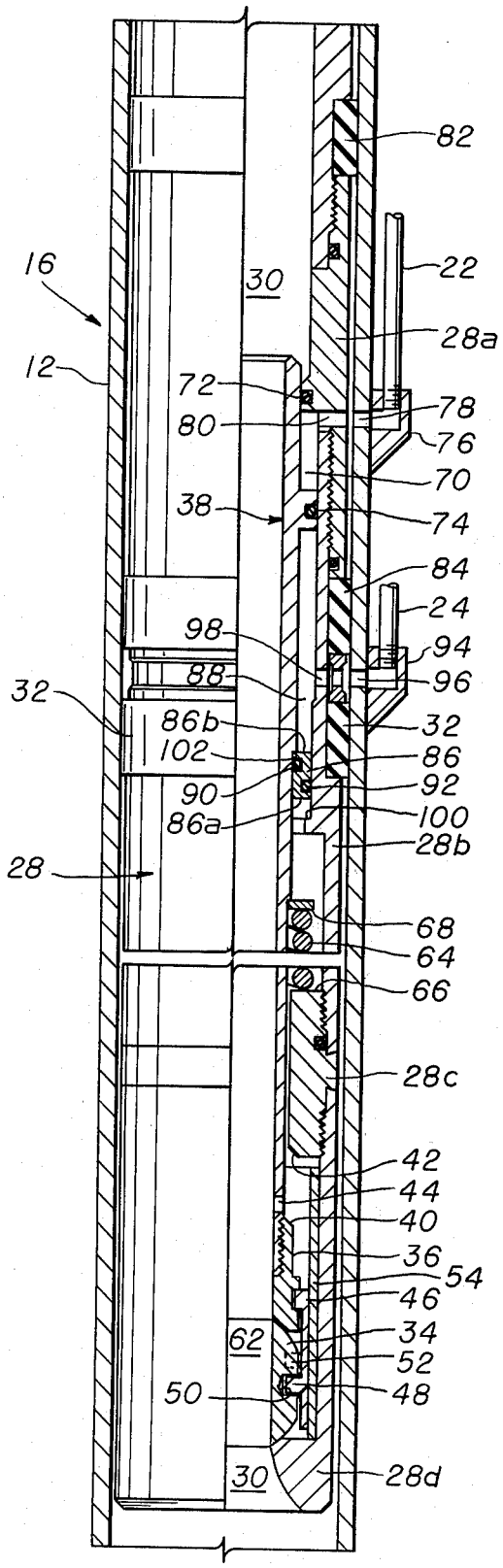
FIG. 1 is a quarter-sectional view of a surface controlled subsurface safety valve, with the valve open.
Figure 2:
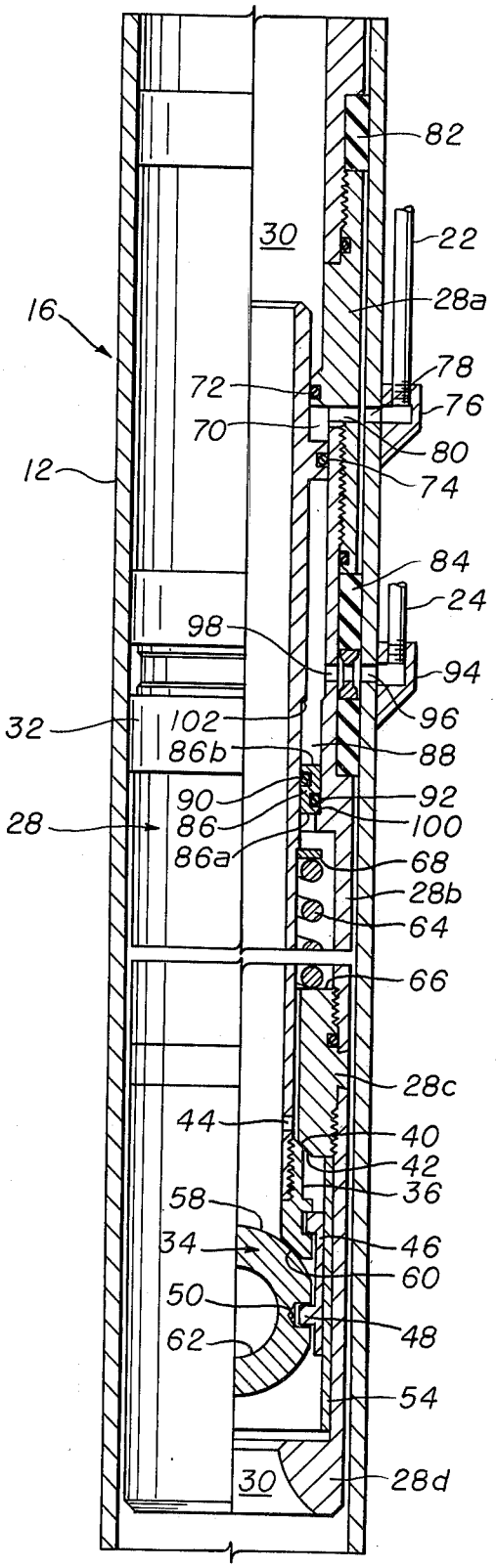
FIG. 2 is a quarter-sectional view of the subsurface safety valve of FIG. 1 with the valve closed due to balance pressure assistance.
Figure 3:
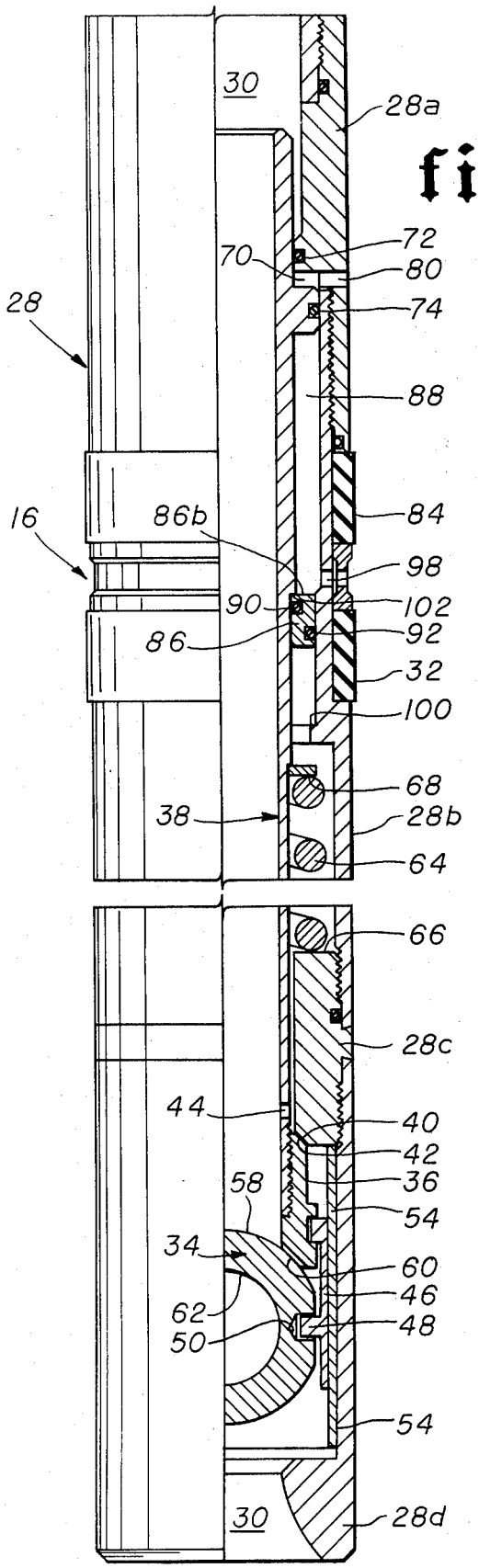
FIG. 3 is a slightly enlarged quarter-sectional view of the valve of FIG. 1 showing the valve closed due to well pressure assistance.

The detailed structure of the surface controlled subsurface safety valve 16 is illustrated in FIGS. 1 through 3. The illustrated subsurface safety valve 16 is a wire line retrievable, tubing safety valve. If desired, the valve could be adapted, by those skilled in the art, to render it a tubing retrievable tubing safety valve or it could be adapted for use with pump down equipment.

The safety valve 16 includes a valve housing 28 for defining the controlled subsurface flow path, closure means for controlling flow through the defined flow path, control pressure responsive means for moving the closure means to a position opening the subsurface flow path when control conduit means 22 is pressurized, and means responsive to the greater of well fluid pressure and pressurized fluid within balance conduit means 24 for assisting movement of the closure means to a position preventing flow through the subsurface flow path.

Valve housing 28 defines the controlled subsurface flow path. It has a bore 30 extending therethrough through which fluids may flow and is formed from interconnected tubular sections 28*a*, 28*b*, 28*c*, and 28*d*. Carried on valve housing 28 is seal means 32 for sealing between valve housing 28 and the tubing string 12. When the subsurface safety valve 16 has been positioned in the tubing string 12 and seal means 32 rendered effective, fluid flow through the tubing string 12 from below the subsurface safety valve 16 is confined to the bore 30 through the valve housing 28.

Closure means controls flow through the housing bore 30. The closure means is disposed in the housing bore 30 and adapted for movement between positions opening and closing the bore 30. Closure means includes ball valve means 34 and annular valve means 36.

Operator means 38 moves the closure means, including ball valve means 34 and annular valve means 36, between their positions opening and closing the housing bore 30. Operator means 38 is disposed in the housing bore and axially movable therein between a first and second position. When operator means 38 is in its first position, closure means closes the housing bore 30 to fluid flow. When operator means 38 is in its second position, closure means opens the housing bore 30 to fluid flow.

The closure means is designed for a sequential opening so that pressures may be equalized across ball valve means 34 before it is rotated towards its bore opening position. The mounting means for ball valve means 34 includes lost motion rotation means. Initial axial movement of operator means 38 from its first position to its second position opens annular valve means 36, axially moves ball valve means 34, but does not result in rotation of ball valve means 34. Well fluids communicate through the open annular valve means 36 around the still closed ball valve means 34. This communication of well fluids will equalize fluid pressures across ball valve means 34. Thereafter, movement of operator means 38 to its second position is continued. Operator means 38 in turn moves ball valve member 34 to its full bore opening position.

Annular valve means 36 may be associated with operator means 38 and is axially movable therewith. It includes a movable metal-to-metal seating surface 40 which sealingly engages a complementary metal-to-metal sealing surface 42 formed on tubular housing section 28*c*. When these metal-to-metal surfaces 40 and 42 are engaged (as shown in FIGS. 2 and 3) fluid communication around ball valve means 34 is prevented. When these metal-to-metal sealing surfaces 40 and 42 are spaced (as shown in FIG. 1), fluid communication around ball valve means 34 is permitted. Well fluids communicate between the housing bore 30 above ball valve means 34 and the housing bore 30 below ball valve means 34 through port means 44 in operator means 38.

Ball valve means 34 is mounted for axial and rotational movement within the housing bore 30. Ball valve means 34 is carried by finger means 46 which depend from annular valve means 36. Finger means 46 include opposed pin means 48 which project into two pivot bores 50 formed on opposite sides of ball valve means 34. Axial movement of ball valve means 34 within the housing bore 30 is caused by the engagement of opposed pin means 48 with pivot bore means 50 and the co-axial movement of finger means 46 and operator means 38. The rotation of ball valve means 34 is due to the engagement of pivot pin means 52 formed on control frame 54 with pivot slot means 56 formed in ball valve member means 34. Control frame 54 is disposed in the housing bore 30. During the initial axial movement of operator means 38 from its first position to second position, control frame 54 undergoes a corresponding axial movement from its first upward position to its second downward position. Because of this corresponding axial movement of control frame 54, no moment arm is imparted by pivot pin means 52 to pivot slot means 56. Therefore, ball valve means 34 remains in its bore closing position during this initial axial movement of operator means 38. Upon additional axial movement of operator means 38, control frame 54 remains stationary. However, ball valve means 34 continues its axial movement due to the engagement of opposed pin means 48 with pivot bore means 50. Pivot pin means 52 imparts a moment arm to ball valve means 34 due to its engagement with pivot slot 56. This moment arm rotates ball valve means 34 to its full bore opening position.

Ball valve means 34 includes an outer sealing surface 58 for sealing with an annular seat 60 formed on annular valve member means 36 when ball valve member means 34 is in its bore closing position. It also includes a passage 62 extending therethrough for providing a full bore opening flow path through the housing bore 30 when ball valve means 34 is in its bore opening position.

To provide a failsafe, normally closed, subsurface safety valve 16, means, such as spring 64, resiliently urge operator means 38 to its first position. Spring means 64 is disposed around operator means 38 between a shoulder 66 formed by tubular housing section 28c and a shoulder 68 carried by operator means 38.

The subsurface safety valve 16 includes control pressure responsive means for moving operator means 38 to its second position. The control pressure responsive means includes control pressure chamber means 70 formed between the valve housing 28 and operator means 38. The control pressure responsive means moves the operator means 38 to its second position, wherein the closure means opens the housing bore 30, when control pressure chamber means 70 is pressurized a sufficient amount.

Control pressure chamber means 70 is defined, in part, by the valve housing 28, operator means 38, a first seal means 72 and a second seal means 74. First seal means 72 is carried by the tubular housing section 28a and seals between the valve housing 28 and operator means 38. First seal means 72 has a first seal effective area which is defined by the circular cross-sectional area within its inside diameter. Second seal means 74 is carried by operator means 38 and seals between valve housing 28 and operator means 38. It has a second seal effective area. The second seal effective area is greater than the first seal effective area of first seal means 72 and is defined by the circular cross-sectional area within the outside diameter of seal means 74.

The pressure of well fluids within the housing bore 30 above the closure means will be effective across the first seal effective area and will produce a force tending to move operator means 38 towards its second position. This produced force will be equal to the product of the pressure of these well fluids times the first seal effective area.

Pressurized control fluid within control pressure chamber means 70 is effective across the control piston area defined by the second seal effective area minus the first seal effective area. Pressurized control fluid within control pressure chamber means 70 produces a force tending to move operator means 38 to its second position. The force produced by pressurized control fluid within control pressure chamber means 70 is equal to the product of the pressure of the control fluid times the control piston area of control pressure chamber means 70.

Control fluid is communicated to control pressure chamber means 70 from the surface by control conduit means 22. As shown, conduit means 22 may terminate at a connector means 76 formed on the tubing string 12 adjacent to the location of control pressure chamber means 70 therein. Control fluid communicates between conduit means 22 and control pressure chamber means 70 through port means 78 formed in the tubing string 12 and port means 80 formed in the valve housing 28. Spaced seal means 82 and 84 carried around valve housing means 28 confine the control fluid to communicating between control conduit means 22 and control pressure chamber means 70.

In addition to the force generated by the resilient urging spring means 64, the safety valve 16 includes additional means for moving operator means 38 to its first position. This additional moving means is responsive to the greater of the pressure of well fluids and pressure balancing fluid. When pressure balancing fluid is effective upon the additional moving means, a resultant force tending to move operator means 38 to its first position is produced even though control conduit means 22 and balance conduit means 24 are pressurized an equal amount. The resultant force is obtained because the balance piston area across which the pressure balancing fluid is effective is greater than the control piston area. The net well pressure force does not oppose the resultant force due to pressure balancing fluid. When well fluid pressure is effective upon the additional moving means, the depth sensitive limitations of the subsurface safety valve 16, vis a vis subsurface safety valves with a single control conduit, are not increased, even as the pressure within balance conduit means 24 at the subsurface safety valve 16 approaches zero.

The additional means for moving the operator means 38 to its first position includes floating piston means 86 and balance pressure chamber means 88.

Floating piston means 86 is disposed between operator means 38 and the valve housing 28. It includes third seal means 90 and fourth seal means 92. Third seal means 90 seals between floating piston means 86 and operator means 38. It has a third seal effective area defined by the circular cross-sectional area within its inside diameter and which is less than the first effective seal area of seal means 72. Fourth seal means 92 seals between floating piston means 86 and the valve housing 28. It has a fourth seal effective area which is greater than the seal effective area of first seal means 72 and less than the seal effective area of second seal means 74. The fourth seal effective area is defined by the circular cross-sectional area within the outside diameter of fourth seal means 92.

Balance pressure chamber means 88 is formed between operator means 38 and valve housing 28. It is defined, in part, by second seal means 74 and floating piston means 86. The balance piston area is defined by the second seal effective area of second seal means 74 minus the third seal effective area of third seal means 90. The balance piston area is therefore greater than the control piston area.

Pressurized control fluid communicates between operating manifold 26 and balance pressure chamber means 88 through balance conduit means 24. Connector means 94 is attached to the tubing string 12 adjacent to the location of balance pressure chamber means 88 therein. The lower end of balance conduit means 24 is attached to connector means 94. Hydraulic balance fluid communicates between balance conduit means 24 and balance pressure chamber means 88 through port means 96 extending through the tubing string 12 and port means 98 in valve housing means 28. Seal means 84 and 32 seal between the valve housing 28 and the tubing string 12 to confine the communication of balancing fluid to between balance conduit means 24 and balance pressure chamber means 88.

When the pressure of well fluids within the bore 30 of the subsurface safety valve is greater than the pressure of balance fluid within balance pressure chamber means 88, the well fluid pressure produces a force tending to move operator means 38 to its first position. The well fluids communicate through port means 44 in operator means 38 and are effective across the fourth effective seal area of fourth seal means 92. Since the fourth seal effective area is greater than the first seal effective area of seal means 72, the net force of well fluid pressure within the bore 30 is equal to the product of the pressure of these well fluids times the annular area defined by the fourth seal effective area of seal means 92 minus the first seal effective area of first seal means 72.

Floating piston means 86 is axially movable within the subsurface safety valve 16. Stop shoulder means 100 formed on valve housing 28 renders effective the third seal effective area of seal means 90 when balance fluid pressure is greater than well fluid pressure. Stop shoulder means 102 formed on the operator means 38 renders effective the fourth seal effective area of seal means 92 when well fluid pressure is greater than pressure balance fluid pressure. One end **86*a* of floating piston means 86 engages stop shoulder means 100 when the balance fluid has the greater pressure while the other end 86*b* of floating piston means 86 enages stop shoulder means 102 when the well fluids have the greater pressure. The stop shoulder 100 and 102 are spaced so that operator means 38 may be moved to its second position without floating piston means 86 preventing such movement due to confinement between stop shoulder means 100 and 102**.

In operation, the surface controlled subsurface safety valve 16 of this invention controls fluid flow through a well at a subsurface location in response to surface controls.

To open the subsurface flow path through the housing bore 30, control fluid in control conduit means 22 is pressurized by operating manifold 26. The pressurized control fluid from control conduit means 22 communicates to control pressure chamber means 70. The pressurized control fluid within control pressure chamber means 70 is effective across the control piston area. The pressure times the control piston area produces a force tending to move operator means 38 downwardly to its second position. when the produced control force is great enough, operator means 38 is moved downwardly. Closure means undergoes a corresponding axial movement and is moved to its position opening the subsurface flow path (See FIG. 1).

To close the subsurface flow path through the housing bore 30 with balance fluid pressure assistance, operating manifold 26 depressurizes control fluid within control conduit means 22 and pressurizes blanace fluid within balance conduit means 24. The resilient urging force of spring means 64 already tends to move operator means 38 to its first position. The pressure force within balance pressure chamber means 88 provides an additional force tending to move operator means 38 to its first position. When balance pressure chamber means 88 is pressurized, floating piston means 86 moves axially unitl its end 96*a* engages stop shoulder means 100. The third seal effective area of third seal means 90 is thereby rendered effective. With the third seal area rendered effective, the pressure of fluid within balance pressure chamber means 88 produces a force tending to move operator means 38 to its first position. Generally, the pressure within balance pressure chamber means 88 and the pressure of fluid within control pressure chamber means 70 will be approximately equal. However, since the balance piston area is greater than the annular control piston area, the resultant force of control fluid and balance fluid tends to move operator means 38 to its first position. If desired, balance pressure chamber means 88 may be pressurized to an amount greater than the pressure of fluid within control pressure means 70. An additional force is thereby provided to move operator means 38 t0 its first position. When the sum of the force of spring means 64 and of pressurized balance pressure chamber means 88 is sufficient, operator means 38 will be moved to its first position. It in turn, moves closure means to its position closing flow through the housing bore 30. The metal-to-metal sealing surfaces 40 and 42 for annular valve means 36 are engaged. The ball valve means 34 is rotated to its position preventing flow through the subsurface safety valve 16 (See FIG. 2).

Even though the balance piston area is greater than the control piston area, the net force of well fluid pressure does not retard valve closure. A first well pressure force, which does tend to retard valve closure, is produced across the first seal effective area. A second, opposing well pressure force is produced across the fourth seal effective area. Since the fourth seal effective area is greater than the first seal effective area, the net well pressure force tends to assist valve closure and never acts to retard valve closure.

Valve closure will be assisted by well fluid pressure whenever it is greater than balance fluid pressure. The well fluids will communicate through port means 44 and will act across floating piston means 86. Floating piston means 86 will be moved axially within the safety valve 16 by well fluid pressure until its upper end 86*b* engages operator stop shoulder means 102. When floating piston means 86 is so engaged, the fourth seal effective area of fourth seal means 92 is rendered force effective. Well fluids within the housing bore 30 produce a force euqal to the product of the well fluid pressure times the fourth seal effective area of fourth seal means 92. That produced force tends to move operator means 38 to its first position. Well fluids are also effective across the first seal effective area of first seal means 72. The force produced across the first seal means 72 tends to move operator means 38 to its second position. However, because the fourth seal effective area is greater than the first seal effective area, the net force produced by well fluid pressure tends to move operator means 38 to its first position. When a sufficient force has been produced by the sum of the well fluid pressure force and the force of spring means 64, operator means 38 is moved to its first position. It, in turn, moves the closure means to its position preventing flow through the subsurface safety valve (see FIG. 3).

Well fluid pressure assistance for closure of the subsurface safety valve 16 does not increase the subsurface safety valve's depth sensitiveness, vis a vis present subsurface safety valves which do not have a balance pressure chamber, even as the pressure of fluid within balance chamber means 88 appproaches zero. Subsurface safety valves become depth sensitive due to the hydrostatic pressure of control fluid within a control conduit being effective across a control piston. The pressure of well fluids, for a subsurface safety valve without a balance pressure chamber, would also be effective across the control piston and produce a force tending to counter the hydrostatic pressure force. For the subsurface safety valve 16 of this invention, the hydrostatic pressure of control fluid is also effective across the control piston area (e.g., the second seal effective area minus the first seal effective area). The net well pressure force for the subsurface safety valve 16 is produced by well fluid pressure effective across the fourth seal effective area minus the first seal effective area. With this net well pressure force, the depth sensitive limitations of the safety valve 16 are not increased, vis a vis safety valves without a balance pressure chamber, even as the balance fluid pressure approaches zero.

From the foregoing, it can be seen that the objects of this invention have been obtained. A surface controlled subsurface safety valve has been provided wherein valve closure is assisted by the greater of well fluid pressure and balance fluid pressure. Balance fluid pressure is effective across an area greater than the control piston area without well pressure retarding movement of the safety valve to its closed position. Well pressure assists valve closure without increasing the depth sensitiveness of the subsurface safety valve, vis a vis present subsurface safety valves without balance pressure assistance for closure, even as the balance pressure approaches zero. Thus, the best of two desired operating conditions is obtained.

The foregoing disclosure and description of this invention are illustrative and explanatory thereof, and various changes in the size, shape, and materials, as well as the details of the illustrated construction, may be made within the scope of the appended claims without departing from the spirit of the invention.

What is claimed is:

1. A surface controlled subsurface safety valve comprising:

a housing having a bore extending therethrough;

closure means disposed in said bore and adapted for movement between position opening and closing said bore;

operator means for moving said closure means and axially movable within said bore between a first and second position;

means for resiliently urging said operator means to its first position wherein said closure means closes said bore;

control pressure responsive means for moving said operator means to its second position, said control pressure responsive means including control pressure chamber means formed between said housing and said operator means and said control presure responsive means moving said operator means to its second position, wherein said closure means opens said bore, when said control pressure chamber means is pressurized a sufficient amount; and means for moving said operator means to said first position, said moving means including:

floating piston means disposed between said operator means and said housing, balance pressure chamber means formed between said operator means and said housing, and defined in part by said floating piston means;

means for exposing one portion of said floating piston to well fluid pressure within said bore; and wherein said floating piston has two positions:

a first position which allows said floating piston to assist said resilient urging means when the pressure of fluid in said bore is greater than the pressure of fluid in said balance chamber means; and a second position which allows the operator means to be responsive only to the pressure of fluid in the balance chamber means and control chamber means when the pressure of fluid in the balance chamber means exceeds the pressure of fluid in said bore.

2. A surface controlled subsurface safety valve comprising:

a housing having a bore extending therethrough;

closure means mounted in said bore and adapted for movement between positions opening and closing said bore;

operator means for moving said closure means and axially movable within said bore between a first and second position.

means for resiliently urging said operator means to its first position wherein said closure means closes said bore;

control pressure responsive means for moving said operator means to its second position, said control pressure responsive means including control pressure chamber means formed between said housing and said operator means and said control pressure responsive means moving said operator means to its second position, wherein said valve member means opens said bore, when said control pressure chamber means is pressurized a sufficient amount; and means for assisting said resilient means to move said operator means including:

floating piston means disposed between said operator means and said housing, and balance pressure chamber means formed between said operator means and said housing and defined in part by said floating piston means, means for exposing one portion of said floating piston to well fluid pressure within said bore;

said assisting means moving said operator means in response to the pressure of fluid within said balance pressure chamber means and the pressure of well fluids within said bore.

3. The surface controlled subsurface safety valve of claim 2 wherein:

said control pressure chamber means is defined, in part, by first seal means for sealing between said operator means and said housing and having a first seal effective area and second seal means for sealing between said operator means and said housing and having a second seal effective area which is greater than said first seal effective area;

pressurized fluid within said control pressure chamber means is effective across the area of said second seal area minus the area of said first seal effective area and produces a force tending to move said operator means to its second position;

said force producing means additionally includes third seal means carried by said floating piston means, said third seal means having a third effective seal area which is less than said first effective seal area; and pressurized fluid within said balance pressure means is effective across the area of said second seal effective area minus the area of said third effective seal area and produces a force tending to move said operator means to said first position.

4. The surface controlled subsurface safety valve of claim 3 additionally including:

stop shoulder means formed on said housing for rendering effective said third effective seal area when said balance pressure chamber means is pressurized an amount greater than the pressure of well fluids within the housing bore.

5. A surface controlled subsurface safety valve comprising:

a housing having a bore extending therethrough;

closure means disposed in said bore and adapted for movement between positions opening and closing said bore;

operator means for moving said closure means and axially movable within said bore between a first and second position;

means for resiliently urging said operator means to its first position wherein said closure means closes said bore;

control pressure responsive means for moving said operator means to its second position, said control pressure responsive means including control pressure chamber means formed between said housing and said operator means and said control pressure responsive means moving said operator means to its second position, wherein said closure means opens said bore, when said control pressure chamber means is pressurized a sufficient amount; and means for producing a force tending to move said operator means to its first position, said force producing means including:

floating piston means disposed between said operator means and said housing, and balance pressure chamber means formed between said operator means and said housing and defined in part by said floating piston means, means for exposing one portion of said floating piston to well fluid pressure within said bore;

said floating piston having two positions:

a first position which allows said floating piston to assist said resilient urging means when the pressure of fluid in said bore is greater than the pressure of fluid in said balance chamber means; and a second position which allows the operator means to be responsive only to the pressure of fluid in the balance chamber means and control chamber means when the pressure of fluid in the balance chamber means exceeds the pressure of fluid in said bore.

6. The surface controlled subsurface safety valve of claim 5 wherein:

said control pressure chamber means is defined in part, by first seal means for sealing between said operator means and said housing and having a first seal effective area and second seal means for sealing between said operator means and said housing and having a second seal effective area which is greater than said first seal effective area;

the pressure of well fluids within the bore of said housing is effective across said first seal effective area and produces a force tending to move said operator means to its second position;

pressurized fluid within said control pressure chamber means is effective across the area of said second seal effective area minus the area of said first seal effective area and produces a force tending to move said operator means to said second position;

said force producing means additionally includes:

seal means carried by said floating piston means and having a seal effective area which is greater than said first seal effective area;

the pressure of well fluid within the bore of said housing is effective across said floating piston seal effective area and produces a force tending to move said operator means to said first position.

7. The surface controlled subsurface safety valve of claim 6 additionally including:

stop shoulder means formed on said operator means for rendering effective said floating piston seal effective area when the pressure of well fluids within said bore is greater than the pressure of fluid within said balance pressure chamber means.

8. A surface controlled subsurface safety valve comprising:

a housing having a bore extending therethrough;

closure means mounted in said bore and adapted for movement between positions opening and closing said bore;

operator means for moving said closure means and axially movable within said housing bore between a first and second position;

means for resiliently urging said operator means to its first position wherein said closure means closes said bore;

control pressure chamber means formed between said operator means and said housing and defined, in part, by first seal means for sealing between said operator means and said housing and having a first seal effective area and second seal means for sealing between said operator means and said housing and having a second seal effective area which is greater than said first seal effective area;

wherein the pressure of well fluids within said housing bore is effective across said first seal effective area and produces a force tending to move said operator means to its second position;

wherein fluid within said control pressure chamber means is effective across the area of said second seal effective area minus the area of said first seal effective area and produces a force tending to move said operator means to said second position;

balance pressure chamber means formed between said operator means and said housing and defined, in part, by said second seal means and floating piston means disposed between said operator means and said housing, said floating piston means incuding:

third seal means having a third effective seal area which is less than said first effective seal area, and fourth seal means having a fourth effective seal area which is greater than said first effective seal area;

wherein the pressure of well fluids within said housing bore is effective across said fourth seal area and produces a force tending to move said operator means to said first position whenever the pressure of well fluids is greater than the pressure of fluid within said balance pressure chamber means; and wherein fluid within said balance pressure chamber means is effective across the area of said second seal effective area minus the area of said third effective seal area and produces a force tending to move said operator means to said first position whenever the pressure of fluid within said balance pressure chamber means is greater than the pressure of well fluids.

9. The surface controlled subsurface safety valve of claim 8 additionally including:

stop shoulder means formed on said valve housing for rendering effective said third effective seal area when said balance pressure chamber means is pressurized an amount greater than the pressure of well fluids within said housing bore; and stop shoulder means formed on said operator means for rendering effective said fourth seal effective area when the pressure of well fluids within the housing bore is greater than the pressure of fluid within said balance pressure chamber means.

* * * * *